United States Patent [19]

McGraw et al.

[11] Patent Number: 4,588,357

[45] Date of Patent: May 13, 1986

[54] HYDRAULIC THROTTLE CONTROL

[75] Inventors: William E. McGraw, Hastings-on-Hudson; Daniel E. Stegner, Smithtown, both of N.Y.

[73] Assignee: Power Draulics-Nielsen, Inc., Mount Vernon, N.Y.

[21] Appl. No.: 633,932

[22] Filed: Jul. 24, 1984

[51] Int. Cl.[4] ..... F04B 49/00; F04B 49/08

[52] U.S. Cl. ..... 417/34; 417/53; 60/431

[58] Field of Search ..... 417/34, 53; 60/431

[56] References Cited

U.S. PATENT DOCUMENTS

| | | | |
|---|---|---|---|
| 2,966,120 | 12/1960 | Morrow | 417/34 |
| 3,116,694 | 1/1964 | Eberhardt | 417/34 |
| 3,923,020 | 12/1975 | Gilligan . | |
| 3,932,993 | 1/1976 | Riedhammer . | |
| 3,941,016 | 3/1976 | Will . | |
| 3,941,143 | 3/1976 | Iijima . | |
| 3,942,325 | 3/1976 | Howeth . | |
| 3,952,614 | 4/1976 | Iijima . | |
| 3,973,472 | 7/1976 | Russell, Jr. . | |
| 3,989,117 | 11/1976 | Hill . | |
| 3,996,743 | 12/1976 | Habiger et al. . | |
| 3,996,840 | 12/1976 | Futamata et al. . | |
| 3,997,282 | 12/1976 | Thomas et al. . | |
| 4,024,711 | 5/1977 | Russell, Jr. . | |
| 4,057,130 | 11/1977 | Robertson . | |
| 4,112,902 | 9/1978 | Torralba . | |
| 4,115,033 | 9/1978 | Kleineisel et al. . | |
| 4,121,609 | 10/1978 | Gold . | |
| 4,179,887 | 12/1979 | Ridder et al. . | |
| 4,367,624 | 1/1983 | Ogata et al. . | |
| 4,387,679 | 6/1983 | Folger et al. . | |
| 4,389,910 | 6/1983 | Lockhart . | |

FOREIGN PATENT DOCUMENTS

| | | | |
|---|---|---|---|
| 1978805 | 5/1978 | Fed. Rep. of Germany | 60/431 |

OTHER PUBLICATIONS

Hunter Hydro-Throttle Control Installation Instructions (8 pages) from Muncie Parts Mfg. Co., Inc., Muncie, IN (not dated).

*Primary Examiner*—William L. Freeh

*Attorney, Agent, or Firm*—Brumbaugh, Graves, Donohue & Raymond

[57] ABSTRACT

An improved hydraulic throttle control apparatus and method for automatically regulating the flow rate of a fixed displacement hydraulic pump driven by an internal combustion engine having a conventional throttle. The apparatus senses the flow requirements of a hydraulic tool, which may be either large or small, that is being driven by the pump. In particular, the apparatus monitors hydraulic pressure in the supply line of the tool, and depending upon the pressure level sensed, sets the engine's throttle to an idle speed position, a high speed position or intermediate speed position. Each throttle position produces a distinct pump flow rate. In a typical embodiment of the apparatus intended for use with a plurality of pumps and tools, the apparatus is comprised of a shuttle valve, first and second hydraulic cylinder means, and a sequence valve.

12 Claims, 4 Drawing Figures

HYDRAULIC THROTTLE CONTROL

This invention relates in general to devices on mobile vehicles for controlling the throttle position of internal combustion engines driving fixed displacement hydraulic pumps, and in particular to devices for controlling flow rates of such pumps in response to the sensed needs of hydraulically operated power tools connected to such pumps.

BACKGROUND OF THE INVENTION

During the last few decades, an increasing number of commercial vehicles used for field work in many industries have been equipped with auxiliary hydraulic power supplies that include one or more fixed displacement hydraulic pumps driven by the vehicle's primary engine. In almost all instances, the vehicle's engine is an internal combustion (I.C.) engine having a conventional throttle arrangement for controlling the speed of the engine via driver-applied pressure upon an accelerator pedal connected by a linkage to the engine's throttle. The throttle and linkage are biased by one or more mechanical springs to return to their idle position. The engine-driven pumps are often used to power manually controlled, hydraulically driven power tools, as well as other hydraulic accessories or attachments.

Such power tools may be categorized into sizes by their hydraulic power requirements, which can be conveniently expressed in terms of flow rate and pressure. The larger tools, such as jack hammers and tampers, may, for example, require a flow rate of about 7 to 9 gallons per minute (gpm) at a pressure of roughly 1300 to 1700 pounds per square inch (psi) for optimal operation. Smaller tools, which include pruners, saws and concrete drills, may, for example, optimally require a flow rate of 3 gpm at a pressure of roughly 1500 to 1900 psi.

In the past, a number of different hydraulic throttle control arrangements have been used to regulate engine speed to maintain a selected output parameter of a hydraulic power supply, such as a flow rate, in a relatively constant state when the power tool attached thereto is operating. One such arrangement employs a hydraulically operated throttle control device, known as the Hunter Hydro-Throttle Control Model No. STA9010, which is available from Muncie Parts Mfg. Co., Inc., Muncie, Indiana. This device, which is customarily rigidly mounted to the engine block or a bracket extending therefrom, includes a cable that is attached to the throttle linkage of the engine. When the hydraulic power supply is not in use, the cable is slack, and thus has no effect on the normal operation of the engine by the vehicle's driver. When the hydraulic power supply is to be used, the vehicle is kept stationary and the engine left on, which allows a throttle control device to establish the desired engine rpm (revolutions per minute) at the appropriate time. With the Hunter device, this occurs when the device senses that a tool connected to the hydraulic pump outlet requires power. The device then moves the attached cable a predetermined distance, thus pulling the throttle to a predetermined position to produce the engine rpm necessary to achieve the desired pump flow rate for the tool.

The Hunter device, once properly installed and adjusted, operates satisfactorily in those situations where only one flow rate is required from the pump. Problems have been encountered, however, when using this device or similar devices in situations where both large and small hydraulic tools are driven from the same pump. Unless these devices are adjusted to match the flow requirements of the particular tool connected to the pump, there will be either too much or too little flow to at least one of the tools from the pump. The problems associated with too little flow are insufficient power to run a large tool, low tool speed and stalling. To remedy these problems, the devices are set to operate the engine so as to produce a flow rate adequate for the large tools used with the pump. This in turn creates several problems for small tools, such as excessive hydraulic pressure, overspeeding and accelerated tool wear. It also causes unnecessary fuel consumption, engine wear, noise and air pollution. More importantly, it often causes the entire auxiliary hydraulic system to overheat, which leads to many problems and substantially increases maintenance costs. The overheating problem is primarily due to the excess flow from the pump dumping over the system relief valve, which is typically set at 2000 psi or above.

It is the primary object of the present invention to provide an improved hydraulic throttle control apparatus which remedies the foregoing problems.

Another object of the present invention is to provide an improved hydraulic throttle control apparatus that senses the hydraulic needs of a power tool attached to an engine-driven fixed displacement hydraulic pump, and responds thereto by selecting one of two predetermined engine speeds for driving the pump.

Still another object is to provide an improved hydraulic throttle control apparatus for regulating the flow rate of an engine-driven fixed displacement pump which can respond to the hydraulic needs of two different power tools simultaneously connected to the apparatus.

A further object is to provide an improved hydraulic control apparatus for the foregoing objectives that is relatively inexpensive, simple to install and adjust, and relatively compact so as to fit under the hood of the vehicle's engine compartment.

Other objects, features and advantages of the present invention will become apparent from the subsequent description and the appended claims taken in conjunction with the accompanying drawings.

SUMMARY OF THE INVENTION

In accordance with one or more of the objects stated above, one embodiment of the present invention is an improved hydraulic throttle control apparatus for automatically regulating the flow rate of a fixed displacement hydraulic pump driven by an I.C. engine having a throttle for adjusting engine speed and spring means attached to the throttle for returning the throttle to its idle speed position. The apparatus is minimally comprised of: first hydraulic cylinder means, hydraulically connectable to the outlet of the pump, for moving the throttle from its idle speed position to a high speed position in response to the outlet pressure of the pump being above a first predetermined setting; and second hydraulic cylinder means, hydraulically connectable to the outlet of the pump and mechanically interconnected to said first hydraulic cylinder means, for moving the throttle from its high speed position to an intermediate speed position in response to the outlet pressure of the pump being above a second predetermined setting which is higher than the first predetermined setting. The foregoing apparatus causes the flow rate of the pump to be low when the pump outlet pressure is below said first setting, high when the pump outlet pressure is between first and second settings, and intermediate when the pump outlet pressure is above the second setting. The first and second cylinder means may each include and share cable means for interconnecting the throttle and apparatus in tension only. First hydraulic cylinder means may be any cylinder-like device which, in response to the predetermined hydraulic pressure, can move a piston or a cylinder rod through a distance, and have said movement directly, or indirectly through other members, cause the throttle to move from its idle speed position to a high speed position.

The apparatus may further include a pressure sensitive valve means, such as a sequence valve, for selectively directing a portion of the hydraulic fluid from the pump to the second cylinder means when the pump outlet pressure is above the second setting.

To make the apparatus suitable for automatically regulating the throttle position of an I.C. engine driving a plurality of fixed displacement hydraulic pumps so as to control the flow rate of the pumps in accordance with the needs of a hydraulically powered tool connected to one of the pumps, the foregoing apparatus may further comprise pump control selection means, such as a shuttle valve. The shuttle valve may be arranged so that the inlet ports of the shuttle valve are connected to the pumps, and the outlet port of the shuttle valve is connected directly to first hydraulic cylinder means and indirectly to second hydraulic cylinder means via the sequence valve. The pump selection control means functions to connect its inlet port having the higher hydraulic pressure to its outlet port.

DETAILED DESCRIPTION OF THE PREFERRED EMBODIMENTS

Figure 1:
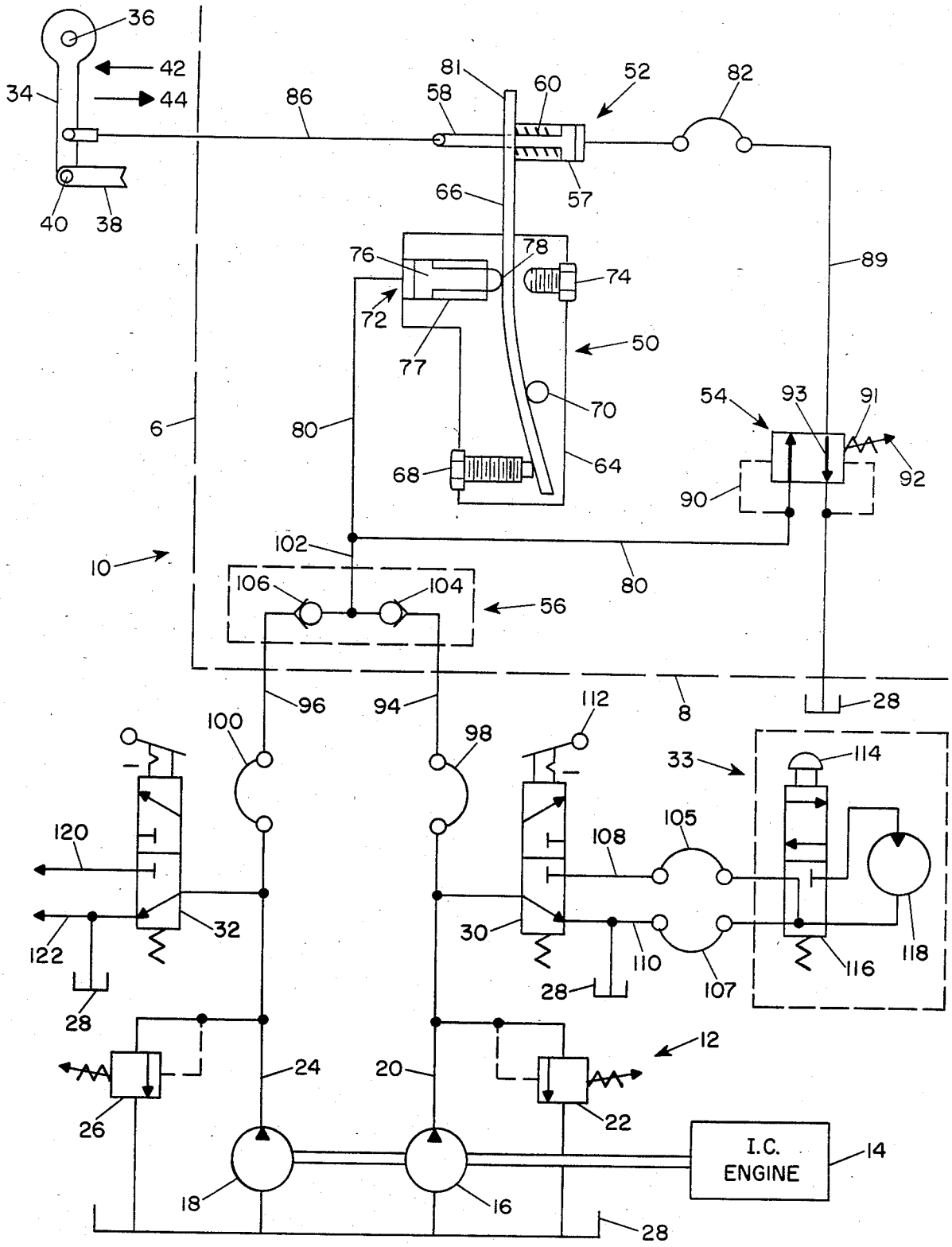
FIG. 1 is a hydraulic diagram in schematic form illustrating a preferred embodiment of the apparatus of the present invention connected to conventional engine-driven hydraulic power supply.

Referring now to the drawings, wherein like reference numerals designate like parts, there is schematically shown in FIG. 1, to the right of dashed vertical line 6 and above dashed horizontal line 8, an improved hydraulic throttle control apparatus 10. Apparatus 10 is operationally connected to an auxiliary hydraulic power supply 12 driven by I.C. engine 14. Items in FIG. 1 to the left of line 6 or below line 8 are of conventional design and do not form part of apparatus 10. As is customary in hydraulic diagrams of this type, all components or elements in FIG. 1 are shown in the position they will assume with engine 14 off and all hydraulic pressure released. Engine 14 drives two fixed displacement hydraulic pumps 16 and 18. The outlet port of pump 16 is connected by tubing or pipe line 20 to system pressure relief valve 22, and the outlet port of pump 18 is similarly connected by tubing or pipe line 24 to system pressure relief valve 26. Pumps 16 and 18 draw hydraulic oil from a common reservoir 28. Pumps 16 and 18, relief valves 22 and 26 and reservoir 28 together comprise hydraulic power supply 12. Manual selector valves 30 and 32 are used to manually open and close the flow of hydraulic oil from pumps 16 and 18 respectively to hydraulically powered tools, such as tool 33 (shown in simplified form), as will be explained in more detail later.

Engine 14 has a conventional throttle arrangement, including an engine throttle linkage lever 34, shown in the upper left portion of FIG. 1, which pivots about pin 36 in response to the driver operating the accelerator pedal of the vehicle (not shown). Lever 34 may be attached to and control, for example, a butterfly valve in a conventional carburetor. Linkage bar 38 connected at one end by pivot pin 40 to lever 34, and at the other end (not shown) to conventional linkage members (also not shown) leading to the accelerator pedal. For convenience, the entire conventional engine throttle linkage will hereinafter be referred to as throttle 34.

Throttle 34 is biased in the direction of arrow 42 in conventional fashion by one or more mechanical springs (not shown) to its idle or low speed position. To increase engine speed above idle, throttle 34 must be pulled in the direction of arrow 44.

Hydraulic throttle control apparatus 10 as shown in FIG. 1 includes first hydraulic cylinder means 50, second hydraulic cylinder means 52, pressure sensitive valve means 54, and pump control selection means 56 hydraulically interconnected as shown. First hydraulic cylinder means 50 is preferably a hydraulic throttle control device, such as the previously mentioned Hunter Hydro-Throttle Control Model STA9010, and is rigidly mounted to engine 14, either directly or through a suitable bracket. Cylinder means 52 is preferably a hydraulic cylinder 57 having a single-ended cylinder rod 58 and a compression spring 60 for returning rod 58 to its retracted position. Pressure sensitive valve means 54 is preferably a conventionally operated sequence valve, and pump control selection means 56 is preferably a shuttle valve.

The hydraulic throttle control device 50 is illustrated schematically in FIG. 1 and includes a housing 64, a leaf spring 66, a leaf spring tension adjustment screw 68, a fulcrum 70 for the leaf spring, and a piston assembly 72. Device 50 may also include a speed adjustment or stop screw 74, which is used to preset the high speed position of throttle 34. Piston assembly 72 includes a piston 76, slidably mounted in bore 77, which is normally biased to its retracted position by leaf spring 66. Leaf spring 66, which is normally straight, is prestressed so that area 78 of spring 66 bears against piston 76. Placement of fulcrum 70 and adjustment of screw 68 determine the amount of hydraulic pressure in line 80 required to advance piston 76.

Cylinder 57 is mounted to and moves with outer portion 81 of leaf spring 66. Flexible hose 82 assures that the movement of cylinder 57 is not constrained by the plumbing connection or conduit 89 between cylinder 57 and sequence valve 54.

Cable 86 mechanically connects throttle 34 to cylinder rod 58 of cylinder 57. When throttle 34 is its idle position, and first and second hydraulic cylinder means 50 and 52 are in their returned position as shown in FIG. 1, there is only a negligible amount of tension in cable 86, or cable 86 is slightly slack. As first hydraulic cylinder means 50 moves from its returned position toward its advanced position, cable 86 is quickly placed in tension and draws throttle 34 in the direction of arrow 44, thus increasing the speed of engine 14.

Sequence valve 54 operates in conventional fashion to allow hydraulic fluid in line 80 to pass to conduit 89 when the hydraulic pressure in line 80, as sensed by pilot line 90, is sufficient to overcome the biasing force of spring 91. Spring 91 is preferably adjustable as indicated by arrow 92. Valve 54 includes a passageway indicated by arrow 93 for allowing hydraulic fluid from cylinder 57 to return to tank 28.

Shuttle valve 56 has two inlet ports 94 and 96, which are connected to hoses 98 and 100 respectively, and one outlet port 102, which is connected to hydraulic line 80. Valve 56 is comprised of two spring-loaded check valves 104 and 106, which are biased in their no-flow direction at a nominal value such as 5 psi. Shuttle value 56 operates to connect the inlet port having the higher hydraulic pressure to outlet port 102. It also prevents hydraulic oil from the higher pressure inlet from back-feeding to the lower pressure inlet port.

Manual selector valves 30 and 32 may be of any conventional or suitable design, such as the manually operated, spring-returned two position, three-way valves shown in FIG. 1. Hydraulically operated tool 33 to be powered by pump 16 is hooked up via suitable connections, and lines such as quick disconnects (not shown) and hoses 105 and 107, to supply line 108 and return line 110 extending from the outlet ports of valve 30. Return line 110 is also connected directly to tank 28. When selector valve 30 is in its returned position as shown, hydraulic fluid from pump 16 is directed through line 110 to tank 28, thus avoiding any significant heat build-up in the tank. To enable operation of the tool, manual operator 112 of valve 30 is actuated and hydraulic fluid from line 30 is allowed to flow into line 108.

Most manually operated, hydraulically driven tools like tool 33 have a trigger or other actuator, illustrated by operator 114, to operate a control valve, such as valve 116, within the tool that turns the tool on and off. Almost all control valves of this type are biased by a spring or other means to return to an open-centered position. In its open-centered position, the control valve dumps all the entire flow of supply line 108 to return line 110. Accordingly, no appreciable pressure develops in line 108. When the trigger on the tool is actuated, the hydraulic oil from line 108 is directed to a hydraulic motor, such as motor 118, or some other source of substantial resistance, and back-pressure quickly develops in line 108 and all lines in open substantially unimpeded fluid communication therewith. As long as the back-pressure remains below the system relief pressure setting of relief valve 22, the back-pressure will be proportional to the combined resistances to the flow rate of pump 16 presented by the tool, valves, lines, and fittings in hydraulic path between the outlet of pump 16 and tank 28. Should the back-pressure start to exceed the system relief pressure, relief valve 22 will open as much as necessary to keep the back-pressure from going any higher.

The operation of apparatus 10 in conjunction with auxiliary hydraulic power supply 12 and engine 14 may now be described by the following three examples. In all three examples, the following facts are treated as given. Pumps 6 and 18 are identical and have the flow rate versus engine rpm characteristics specified in columns B and C of Table 1:

TABLE 1

| (A) ENGINE THROTTLE POSITION OR SETTING | (B) ENGINE SPEED (rpm) | (C) PUMP FLOW RATE (gpm) | (D) APPROX. PUMP PRESS. (IN psi) AT GIVEN ENGINE SPEED |
|---|---|---|---|
| IDLE (OR LOW) | 600 | 2 | BELOW 1300 |
| INTERMEDIATE | 900 | 3 | 1300 to 1800 |
| HIGH | 2700 | 9 | 1800 AND UP |

The torque of leaf spring 66 of first hydraulic cylinder means 50 is selected so that piston 76 will be fully extended when the pressure in line 80 is at or above 1300 psi, and that in such a position, leaf spring 66 draws upon cable 86 sufficiently to speed up engine 14 to 2700 rpm. Sequence valve 54 is set to operate at 1700 psi, and system relief valves 22 and 26 are set to relieve at 2000 psi. Engine 14 is on and initially running at its idle speed, which is 600 rpm. A power tool is connected up to lines 108 and 110 extending from manual selector valve 30; valve 30 is actuated to direct flow from pump 16 to the power tool. In the first example, we will further assume that: pump 18 is unused, and selector valve 32 is in its spring-returned position as shown to divert the flow from pump 18 to tank 28.

Initially, the power tool's trigger is released, and the open-centered control valve operated by the trigger directs the 2 gpm flow associated with idle speed from line 108 to tank line 110, so no appreciable back-pressure develops in line 108. When the tool's trigger is actuated, the flow in line 108 encounters resistance, and pressure rapidly rises to 1500 psi. At that time, device 50 then actuates, due to a substantially identical pressure in line 80. Leaf spring 66 shifts to its advanced position, pulling throttle 34 (via cable 86) to its high speed position or setting, which speeds up engine 14 from 600 to 2700 rpm, thereby increasing the output of pump 16 from 2 to 9 gpm.

If the power tool in use is a larger tool, requiring approximately 7 to 9 gpm at 1300 to 1650 psi, apparatus 10 will remain as it is, with first cylinder means 50 actuated, and second cylinder means 56 in its original unactuated state. If the power tool is a smaller tool that requires substantially less than 7 gpm, the flow from pump 16 in excess of the tool's needs will cause a rapid build-up of pressure in line 80 to 1700 psi and above. At such pressures, sequence valve 54 actuates, allowing flow from line 80 to line 89, which actuates second cylinder means 52. Piston rod 58 fully extends, which allows spring-returned throttle 34 to move in the direction of arrow 42 and assume an intermediate position between its idle and high speed positions. The location of this intermediate position is selected through adjustments at installation to correspond to the flow rate required for the small tool. If the small tool requires 3 gpm, for example, the adjustments should set the engine speed for 900 rpm, as is indicated in Table 1 above.

As long as the back-pressure produced by operating a small tool remains at or above 1700 psi, sequence valve 54 remains actuated, and engine 14 continues to run at its intermediate speed. When the tool's trigger is released, the open-centered control valve of the tool once again diverts the output of pump 16 to tank, causing the pressure in lines 24 and 80 to very rapidly drop well below 1300 psi. This allows leaf spring 66 and cylinder rod 58 to return to their original retracted positions, thus returning throttle 34 to its idle position. Note that hydraulic fluid in piston assembly 72 will bleed through conventional leakage paths in valves 54 and/or 56 to allow piston 76 to return. When the tool's trigger is actuated again, the above-described sequence repeats itself.

The second example illustrates a significant benefit that may be obtained from apparatus 10, even when only using apparatus 10 with a single large power tool. Some large tools may substantially slow down or stall out on occasion due to worn tool bits or other problems. Unless the tool's operator senses such an overload condition promptly, most conventional throttle control devices allow the back-pressure to build to system relief valve pressure, at which time most or all of the flow of the pump is dumped over the relief valve. With large tools this will, if continued, quickly overheat the hydraulic reservoir. The operation of apparatus 10 as described in the first example significantly reduces the rate of reservoir heating when a large tool is connected by cutting the flow rate of pump 16 by two-thirds as soon as the back-pressure builds up to 1800 psi or above. Apparatus 10 maintains pressure on the stalled tool, although at a reduced pump flow rate, which allows the person operating the tool a significantly longer time to release the tool's trigger before the reservoir overheats. In addition, the sound of engine 14 slowing down while a tool is operating can provide the person operating the tool with a convenient means for recognizing that the tool is overloaded and that corrective action should be taken.

In the third example, the operation of apparatus 10 in conjunction with two tools simultaneously in use is explained. The facts given in this example are the same as those of the first example, except that a second tool to be driven by pump 18 is connected up to lines 120 and 122 extending from manual selector valve 32, which is actuated. In this example, there are three possible combinations of power tool sizes: two large tools; two small tools; and one large and one small tool. In all three combinations, the apparatus 10 operates in the same basic manner as described in the first example. The only differences in operation relate to the effect of shuttle valve 56 in the hydraulic circuit of FIG. 1. As previously explained, shuttle valve 56 connects its input port having the highest pressure to its output port. Accordingly, when two tools are being driven power supply 12, the tool producing the greatest back-pressure will be selected by shuttle valve 56 for connection to line 80, and will control the operation of apparatus 10. When two large tools are connected up, throttle 34 will be shifted by apparatus 10 to its high speed position when either tool or both of the tools are operating normally. When two small tools are connected up, throttle 34 will be shifted to the intermediate position any time either tool or both of the tools are operating.

When one large tool and one small tool are connected up, throttle 34 will be shifted to its intermediate position any time the small tool is operating, irrespective of whether or not the large tool is operating. Only when the small tool is not operating, will the lower back pressure from the large tool be allowed to cause the throttle to advance to its high speed position.

Figure 2:
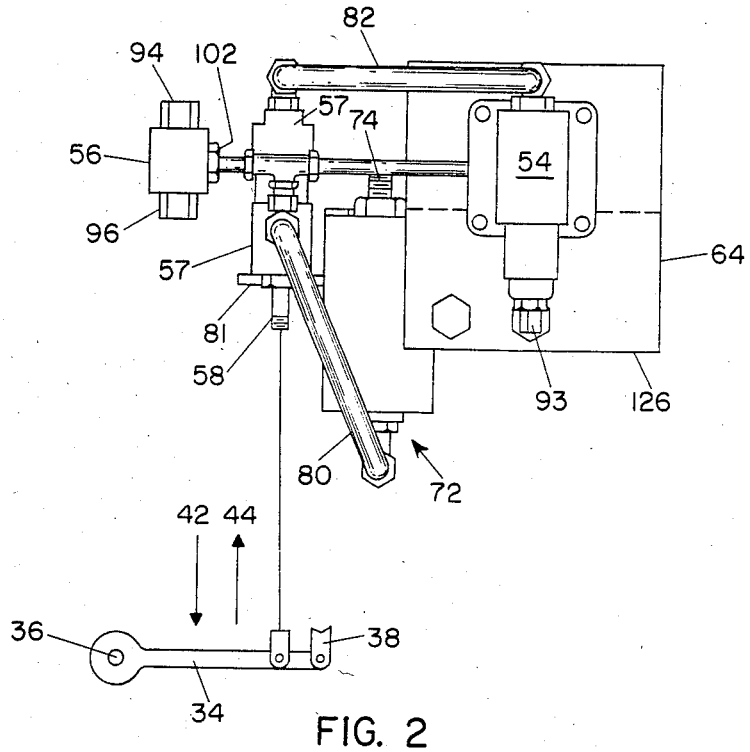
FIG. 2 shows a plan view of one possible physical embodiment of the apparatus illustrated in FIG. 1.
Figure 3:
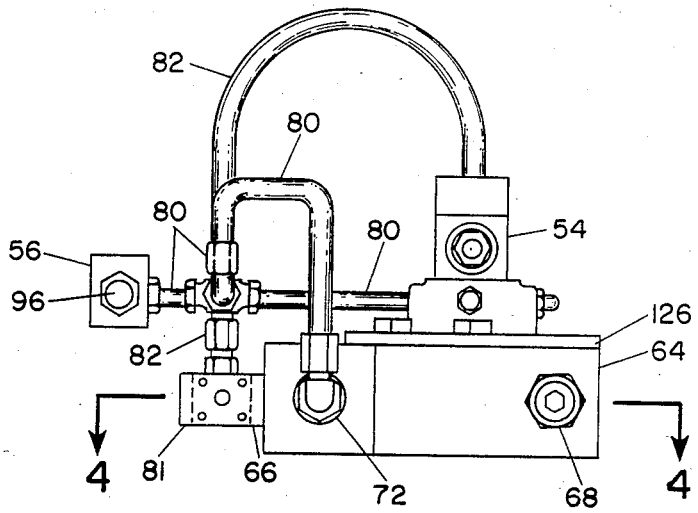
FIG. 3 is a side elevational view of the apparatus shown in FIG. 2.
Figure 4:
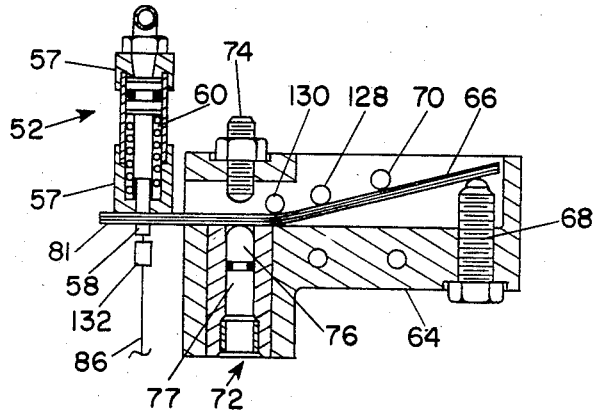
FIG. 4 is a partial cross-sectional view of the FIG. 1 apparatus taken along line 4—4 in FIG. 3.

Turning to FIGS. 2, 3 and 4, the details of one physical embodiment of apparatus 10, comprised largely of commercially available components, may now be described. In this embodiment, first hydraulic cylinder means 50 is the aforementioned Hunter Hydro-control device. Sequence valve 54 may be comprised of the following Vickers components: sequence valve No. DGMRl-3-PP-CW-20, subplate No. DGMS-3-1E-10S, and crossover plate No. DGMA-3-Cl-11. Shuttle valve 56 may be a Vickers No. DSBl-03-10, and second hydraulic cylinder means 52 maybe comprised of a Bakelaar cylinder No. HTBl with ⅝ inch bore and 3/32 inch stroke, modified by installation of compression spring 60 to retract cylinder rod 58.

FIGS. 2 and 3 show that hose 82 may be used with appropriate fittings to hydraulically interconnect sequence valve 54 to cylinder 57. Subplate 126 may be bolted to housing 64 so that sequence valve 54 need not be separately mounted. Shuttle valve 56 is mounted in-line, and physically supported lines 80 extending to it.

As indicated in FIG. 4, leaf spring 66 may be and preferably is comprised of more than one leaf. Leaf spring 66 is approximately an inch wide, permitting cylinder 57 to be bolted to it as indicated in FIG. 3. The outer portion of cylinder rod 58 may be provided with threaded means 132 for making minor adjustments to the length of cable 86 attached thereto. Similarly, cylinder 57 is preferably provided with an adjustment mechanism that permits the length of the stroke of cylinder 57 to be easily changed as required to achieve the desired intermediate throttle position setting. In FIG. 4, two alternate holes 128 and 130 are shown in housing 64 for receiving fulcrum 70 in order to change the forces applied by leaf spring 66 on piston 76 as it is prestressed between fulcrum 70 and spring tension adjustment screw 68.

Those skilled in the art, having read the foregoing disclosure, will appreciate that apparatus 10 of FIG. 1, if produced in appreciable quantities, would preferably be constructed, not of individual commercially available components as shown in FIGS. 2 through 4, but as an assembly of specially designed components mounted in single housing or casting. In such an embodiment, first hydraulic cylinder means 50 would be mounted stationary with respect to the housing, and have a spring-loaded piston or rod which is movable with respect to the housing. Said piston or rod would directly or indirectly attach to move cable 86 and second hydraulic cylinder means 52. Means 52, when hydraulically actuated via pressure sensitive valve means 54 or equivalent means would further move cable 86 to its intermediate position.

It is to be appreciated that when apparatus 10 is used with a single fixed displacement pump, shuttle valve 56 may be eliminated by connecting the pump outlet 20 directly to line 80. It is also to be appreciated that the abovedescribed apparatus, with appropriate changes of spring rates, and screw and stop adjustments, etc., is well-suited for use with hydraulic power tools and/or pumps operating in pressure and flow ranges other than the exemplary ranges given above.

While the invention has been described with reference to a preferred embodiment thereof, it will be understood by those skilled in the art that various changes in form and details may be made therein without departing from the spirit and scope of the invention, as defined by the following claims.

We claim:

1. An improved hydraulic throttle control apparatus for automatically regulating the flow rate of a fixed displacement hydraulic pump driven by an internal combustion engine having a throttle for adjusting engine speed and spring means attached to the throttle for returning the throttle to its idle speed position, said control apparatus comprising:

a control member connectable to the throttle for actuating the throttle;

a first control means, responsive to outlet pressure of the pump, for maintaining said control member in and idle position responsive to pump pressures below a first predetermined value, and for urging said control member into a high-speed position responsive to pump pressures higher than said first predetermined value; and a second control means, actuated responsive to outlet pressure of the pump being higher than a second predetermined value, which second value is higher than said first value, for moving said control member from said high-speed position to a position intermediate said idle and high-speed positions, wherein at pump pressures below said second predetermined value said second control means remains unactuated;

whereby the engine RPM and the flow-rate of a pump controlled by said apparatus is low when the pump outlet pressure is below said first value, high when the pump outler pressure is between the first and second values, and intermediate when the pump outlet pressure is higher than the second value.

2. The apparatus according to claim 1, further comprising:

pressure-sensitive valve means for selectively directing hydraulic fluid from the pump to the second cylinder means only when the pump outlet pressure is above the said second predetermined value.

3. The apparatus according to claim 2, wherein the valve means is a sequence valve and includes venting means for allowing hydraulic fluid in the second cylinder means to return to tank when the valve is not actuated.

4. The apparatus according to claim 1, further comprising:

a pmup control selection means, having a plurality of inlet ports, one for each pump, connectable to two pumps, and an outlet port, for connecting the inlet port having the higher hydraulic pressure to the outlet port, wherein said first control means and said second control means are connected to the outlet port and are thereby responsive to the pump having the higher outlet pressure such that the flow rate of both pumps is established by the highest pressure at the inlet ports of said pump selection means.

5. The apparatus according to claim 4, wherein the pump selection control means is a shuttle valve.

6. The apparatus according to claim 1, wherein said first control means comprises a first hydraulic cylinder means and means for connecting said first hydraulic cylinder means to the pump outlet to be actuated responsive to pump outlet pressure; and wherein said second control means comprises a second hydraulic cylinder means and means for connecting said second hydraulic cylinder means to the pump outlet to be actuated responsive to pump outlet pressure; and wherein said second control means is mechanically interconnected with said first control means.

7. The apparatus according to claim 6, wherein said second hydraulic cylinder means is connected to an output of said first hydraulic cylinder means and wherein said control member is a piston rod forming part of said second hydraulic cylinder means.

8. The apparatus according claim 6, wherein said first hydraulic cylinder means includes a first piston means, a leaf spring acting on said control member, and means for biasing said spring against said first piston means.

9. The apparatus according to claim 8, wherein said second hydraulic cylinder means is mounted on said leaf spring, and wherein said control member is a piston rod forming part of said second hydraulic cylinder means.

10. The apparatus according to claim 9, wherein the second hydraulic cylinder means comprises:

a hydraulic cylinder containing said piston rod and a compression spring for returning said piston rod to its retracted position, said piston rod being movable to its extended position by hydraulic fluid pumped into the cylinder that overcomes the biasing force of the compression spring.

11. An auxiliary hydraulic power supply device comprising:

a fixed displacement hydraulic pump;

an internal combustion engine having a throttle for adjusting engine speed and spring means attached to the throttle for returning the throttle to its idle speed position;

means connected between said engine and pump for driving said pump;

a control apparatus for automatically regulating the flow rate of said pump comprising a first control member connected to the throttle for actuating the throttle, said control member having an idle position, a high-speed position, and an intermediate position, corresponding to idle, high RPM, and intermediate RPM position of said throttle; a first control means, responsive to the outlet pressure of the pump, for maintaining said control member in an idle position responsive to pump pressure below a first predetermined value, and for urging said control member into said high-speed position responsive to pump pressure being higher than said first predetermined value; and a second control means, actuated responsive to the outlet pressure of the pump being higher than a second predetermined value, which is higher than said first value, for moving said control member from said high-speed position to said intermediate position, wherein at pump pressure below said second predetermined valve said second control means remains unactuated; and a connector means communicating with the pump outlet for connecting a hydraulically-driven tool, said connecting means including means for returning pump outlet to a reservoir when a tool is not connected, for maintaining outlet pressure below said first and said second values when no tool is operating, whereby at low fluid pressures, corresponding to no tool being driven, said control member and throttle remain in said the idle position, at tool operating conditions establishing a system pressure between said first and second value, said control member and throttle are maintained in their high speed positions, and at tool operating conditions establishing a system pressure higher than said second value, said control member and throttle will be moved to the intermediate engine position.

12. A method for automatically regulating the throttle position of an internal combustion engine driving a fixed displacement hydraulic pump in order to control the flow rate of the pump in accordance with the needs of a hydraulically power tool connected to the pump, comprising the steps of:

sensing the back-pressure in the hydraulic line supplying hydraulic fluid from the pump to the tool;

maintaining said throttle in a normal idle speed position at low pressures;

moving said throttle from its idle speed position to a high-speed position in response to sensing back pressure higher than a first predetermined value; and moving the throttle from its high-speed position to an intermediate speed position, for reducing engine RPM and pump output, responsive to sensing back-pressure higher than a second predetermined va-1ue, which second predetermined value is higher than the first value;

whereby the flow rate of the pump is low when the back-pressure is below the first setting; high when the back-pressure is between the first and second settings, and intermediate when the back-pressure is above the second setting.

* * * * *

UNITED STATES PATENT AND TRADEMARK OFFICE

CERTIFICATE OF CORRECTION

PATENT NO. : 4,588,357

DATED : May 13, 1986

INVENTOR(S) : McGraw et al.

It is certified that error appears in the above-identified patent and that said Letters Patent is hereby corrected as shown below:

Col. 4, line 13, after "38" insert --is--;

Col. 6, line 3, "6" should read --16--;

Col. 9, line 27, "outler" should read --outlet--;

line 31, "claim 1" should read --claim 6--;

line 44, "pmup" should read --pump--;

Col. 10, line 44, "pressure" should read --pressures--;

line 51, "pressure" should read --pressures--; and line 62, delete "the".

Signed and Sealed this

*Ninth* Day of *September 1986*

[SEAL]

*Attest:*

DONALD J. QUIGG

*Attesting Officer*

*Commissioner of Patents and Trademarks*